US007726367B2

(12) United States Patent
Suzuki

(10) Patent No.: US 7,726,367 B2
(45) Date of Patent: Jun. 1, 2010

(54) METHOD OF PROCESSING WOODEN PIECE

(75) Inventor: Tatsuya Suzuki, Tokyo (JP)

(73) Assignee: Olympus Corporation, Tokyo (JP)

( * ) Notice: Subject to any disclaimer, the term of this patent is extended or adjusted under 35 U.S.C. 154(b) by 0 days.

(21) Appl. No.: 12/355,496

(22) Filed: Jan. 16, 2009

(65) Prior Publication Data

US 2009/0126829 A1 May 21, 2009

Related U.S. Application Data

(63) Continuation of application No. PCT/JP2007/063785, filed on Jul. 11, 2007.

(30) Foreign Application Priority Data

Jul. 19, 2006 (JP) ..... 2006-197181
May 2, 2007 (JP) ..... 2007-121891

(51) Int. Cl.
*B27H 1/00* (2006.01)

(52) U.S. Cl. ..... 144/360; 144/380; 144/381

(58) Field of Classification Search ..... 144/259, 144/267, 270, 360, 380, 381, 359; 425/356, 425/394, 398; 428/105, 106, 114
See application file for complete search history.

(56) References Cited

U.S. PATENT DOCUMENTS 5,343,913 A * 9/1994 Tanahashi et al. ..... 144/380
7,395,844 B2 * 7/2008 Suzuki ..... 144/361

FOREIGN PATENT DOCUMENTS

JP 11-077619 3/1999
JP 3078452 8/2000

* cited by examiner

*Primary Examiner*—Shelley Self
(74) *Attorney, Agent, or Firm*—Hogan & Haratson LLP

(57) ABSTRACT

A method of processing a wooden piece into a predetermined shape by compressing the wooden piece, includes bending a raw-material piece which is a wooden piece to be processed and is placed in a humid condition of high temperature, cutting out a blank-material piece from the raw-material piece bent in the bending so that the blank-material piece includes at least a part of a bent portion of the raw-material piece, and compressing the blank-material piece cut out in the cutting out in a water vapor atmosphere of a temperature and a pressure higher than those of an atmospheric air.

6 Claims, 10 Drawing Sheets

METHOD OF PROCESSING WOODEN PIECE

CROSS-REFERENCE TO RELATED APPLICATIONS

This application is a continuation of PCT international application Ser. No. PCT/JP2007/063785 filed Jul. 11, 2007 which designates the United States, incorporated herein by reference, and which claims the benefit of priority from Japanese Patent Application No. 2006-197181, filed Jul. 19, 2006, and Japanese Patent Application No. 2007-121891, filed May 2, 2007, all incorporated herein by reference.

BACKGROUND OF THE INVENTION

1. Field of the Invention

The present invention relates to a method of processing a wooden piece into a predetermined shape by compressing the wooden piece.

2. Description of the Related Art

In recent years, wood which is a natural material attracts attention. With a wide variety of grain patterns, wood products exhibit individual features depending on positions of raw wood from which the particular wood products are cut out. In addition, surface flaws and discolorations caused by a long-term use create unique textures which tend to evoke warm and familiar feeling in the user. Thus, the wood attracts attention as a material for products of uniqueness and taste which cannot be found in products made of synthetic resin or light metals. Techniques for processing wood are also developing dramatically.

According to one conventionally known technique for processing a wooden piece: a wooden board is softened with water absorption and compressed; the compressed wooden board is cut along a direction substantially parallel with a direction of the compressive force, whereby a primary fixed product with a board-like shape is obtained; and the primary fixed product is deformed into a predetermined three-dimensional shape under heat and moisture (see, for example, Japanese Patent No. 3078452). Further, according to another conventional technique, a softened wooden board is compressed and temporarily fixed and left in a prepared mold until the wooden board recovers, so that a wooden product with a desired shape can be obtained (see, for example, Japanese Patent Application Laid-Open No. H11-77619). According to the techniques as described above, thickness of the wooden piece and compression rate are determined based on various aspects such as an individual difference, a kind, required strength after processing, and a purpose of use.

SUMMARY OF THE INVENTION

A method of processing a wooden piece into a predetermined shape by compressing the wooden piece according to one aspect of the present invention includes bending a raw-material piece which is a wooden piece to be processed and is placed in a humid condition of high temperature, cutting out a blank-material piece from the raw-material piece bent in the bending so that the blank-material piece includes at least a part of a bent portion of the raw-material piece, and compressing the blank-material piece cut out in the cutting out in a water vapor atmosphere of a temperature and a pressure higher than those of an atmospheric air.

The above and other features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention (hereinafter, simply referred to as "embodiments") will be described below with reference to the accompanying drawings. The drawings referred to in the following description are merely schematic, and the same object may be shown in different dimensions and scales in different drawings.

First Embodiment

Figure 1:
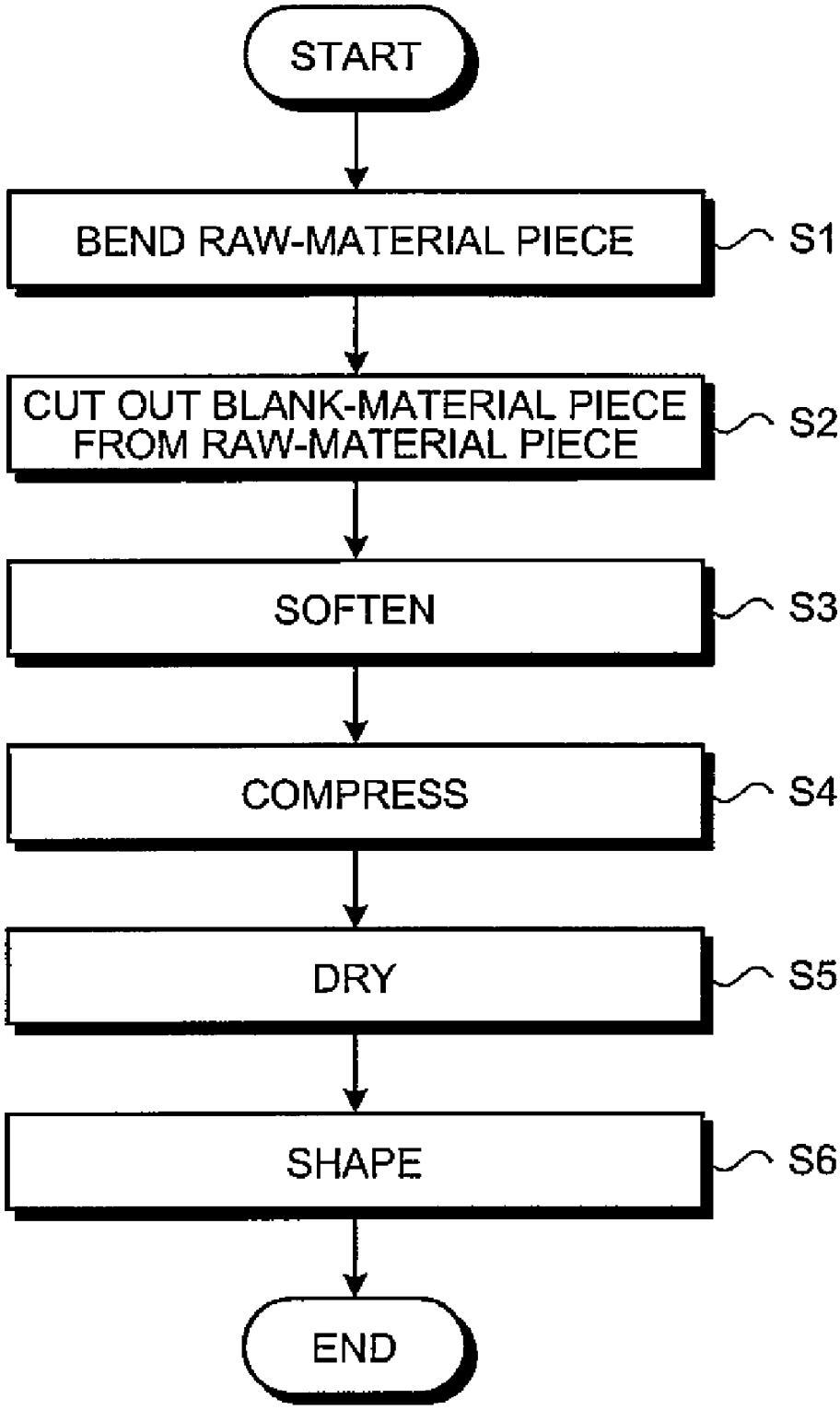
FIG. 1 is a flowchart of an overall process procedure of a method of processing a wooden piece according to a first embodiment of the present invention.
Figure 2:
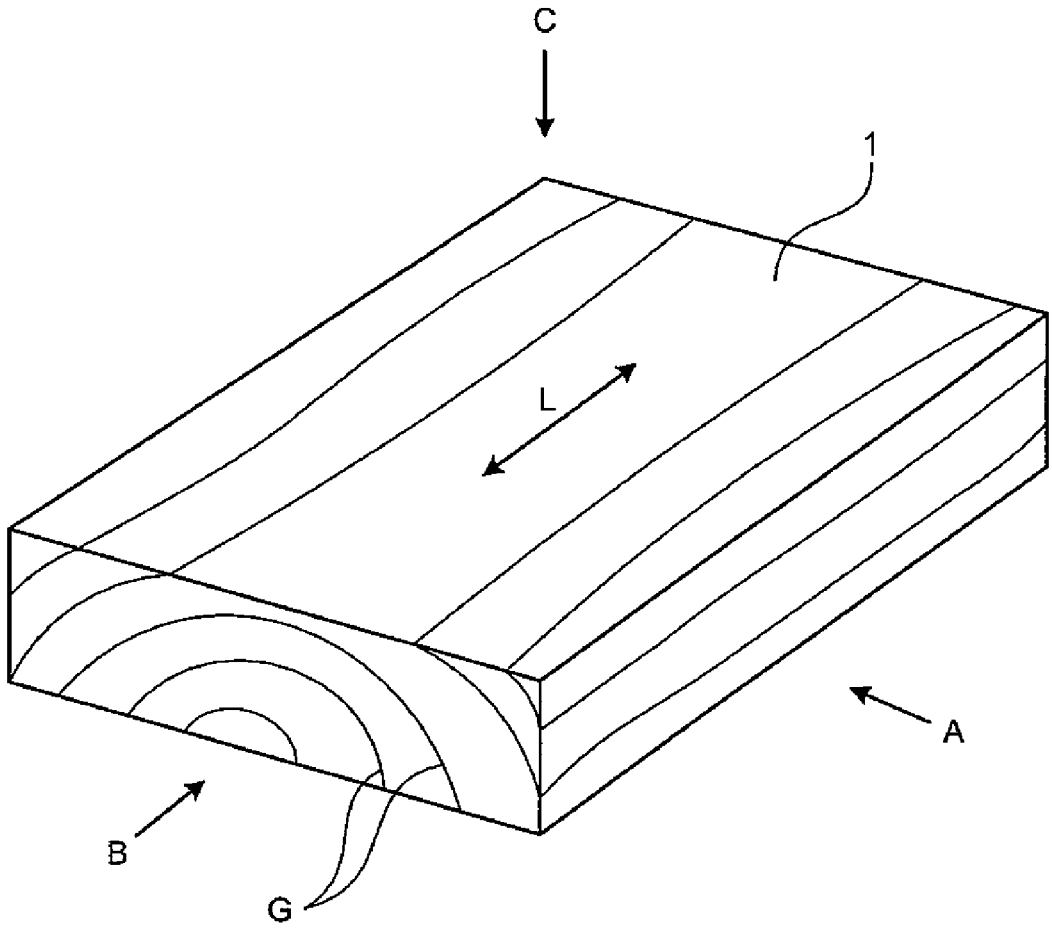
FIG. 2 is a perspective view of a configuration of a raw-material piece for a blank-material piece.
Figure 3:
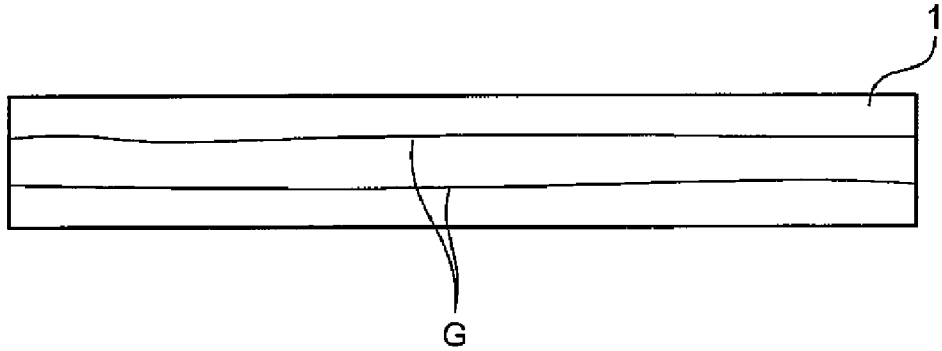
FIG. 3 is a side view in a direction of an arrow A shown in FIG. 2.

FIG. 1 is a flowchart of an overall process procedure of a method of processing a wooden piece according to a first embodiment of the present invention. In the first embodiment, firstly, a raw-material piece 1 which is a wooden piece to be processed is bent (step S1). FIG. 2 is a perspective view of a configuration of a raw-material piece used in the first embodiment. Further, FIG. 3 is a side view in a direction of an arrow A shown in FIG. 2. The raw-material piece 1 shown in FIGS. 2 and 3 is a flat-grain board of a flat plate-like shape. The raw-material piece 1 is cut out from uncompressed raw wood, for example, and in which a fiber direction L is substantially parallel to a longitudinal direction. Grains G on a top surface of the raw-material piece 1 run mostly along the longitudinal direction. On the other hand, grains G on a side surface (side surface shown as a bottom left portion in FIG. 2) extending substantially perpendicular to the fiber direction L of the raw-material piece 1 exhibit growth rings. Here, the raw-material piece 1 can be cut out from any raw wood selected as an optimal one from Japanese cedar, hiba cedar, paulownia, Japanese cypress, pine, cherry, zelkova, ebony wood, palisander, bamboo, teak, mahogany, and rosewood depending on purpose of use and the like of the wooden piece.

Figure 4:
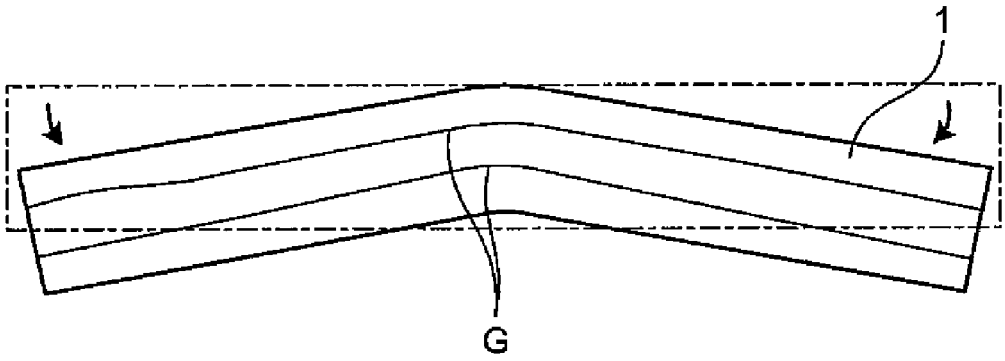
FIG. 4 is a schematic view illustrating an outline of a bending process of the method of processing a wooden piece according to the first embodiment of the present invention.

FIG. 4 is a schematic view illustrating how a bending force is applied to the raw-material piece 1, and is a view seen from the same side as in FIG. 3 (i.e., in the direction indicated by the arrow A in FIG. 2). In FIG. 4, a folding line is represented by a straight line running at the center of the longitudinal direction of the raw-material piece 1 parallel to a short-side direction of the raw-material piece 1, and two edge portions in the longitudinal direction are bent toward the center of the longitudinal direction. Therefore, the raw-material piece 1 is deformed into a reverse V-shape when viewed from the direction of the arrow A of FIG. 2. Accordingly, the grain G is bent around the center in a reverse V-shape as shown in FIG. 4. A jig such as a lever may be employed to bend the raw-material piece 1 as described above so that the raw-material piece 1 is bent at a desirable supporting point, i.e., along a desirable folding line with the two edge portions folded in a direction indicated by arrows in FIG. 4. A position of the folding line for bending may be determined depending on a running direction of the grains G of the raw-material piece 1, a desirable grain pattern to be cut out from the raw-material piece 1, and the like. The raw-material piece 1 may be bent in an opposite direction from the direction shown in FIG. 4 so that the raw-material piece has a V-shape when viewed from the direction of the arrow A of FIG. 2.

In general, in the first embodiment, a bending force can be applied across a surface of the raw-material piece 1 of a flat board-like shape. For example, it is possible to prepare an upper mold an a lower mold respectively having a positive and a negative curvature in the longitudinal direction of the raw-material piece 1, sandwich the raw-material piece 1 between the upper and the lower molds for a predetermined time period, and bend the raw-material piece 1 in a shape conforming with the curvature of each of the upper and the lower molds. Though the degree of bending in this process is smaller than that in the process shown in FIG. 4, this mold-using technique is advantageous in that a deformed grain pattern can be obtained through bending irrespective of a cut-out position of the blank-material piece in the raw-material piece 1.

Common to the above-described bending techniques of the raw-material piece 1 is that the volume of the raw-material piece 1 substantially does not change through the bending process. In this sense, the bending process of the first embodiment can be regarded as a deforming process which substantially does not have a compressive effect.

In step S1, the raw-material piece 1 must be softened to such a degree that a bending stress working thereon as described above does not cause crack and the like. Hence, during step S1, the raw-material piece 1 is placed in a humid condition of high temperature. Here, "humid condition of high temperature" refers to an atmosphere where the temperature is 60 to 160° C. and the humidity is 60 to 100%, for example. In the first embodiment, the raw-material piece 1 is left in such atmosphere for 20 to 120 minutes prior to the bending process so that the raw-material piece 1 is softened. The temperature and the humidity of the atmosphere, and the time the raw-material piece is left in the atmosphere may be determined according to the type, size, and shape of the raw-material piece 1, a direction of application of bending force, and the like.

Various known methods can be employed to put the raw-material piece 1 in the humid condition of high temperature which is similar to the one described above, for example, one can boil the raw-material piece 1, or radiate microwaves to the moistened raw-material piece 1.

Figure 5:
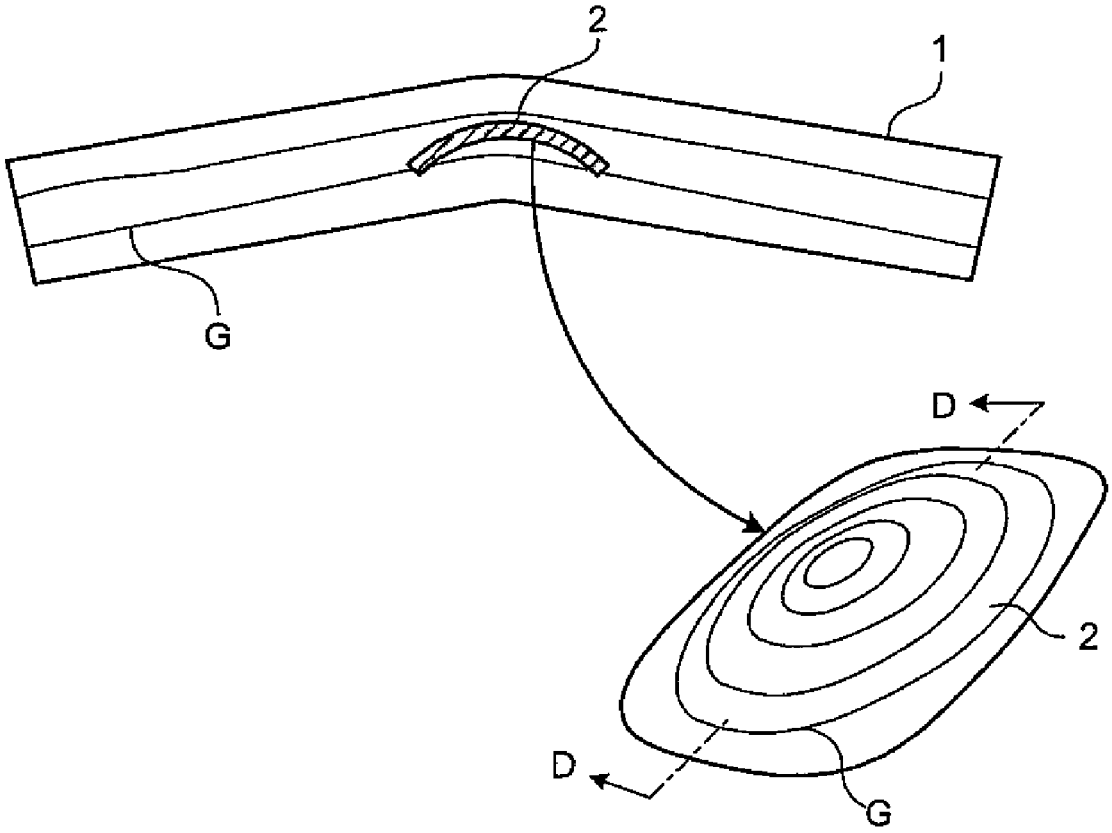
FIG. 5 is a schematic view illustrating an outline of a cutting-out process of the method of processing a wooden piece according to the first embodiment of the present invention.

Then, a blank-material piece of a predetermined shape is cut out from the raw-material piece 1 through cutting or the like (step S2) after the bending process in step S1. FIG. 5 is a schematic view illustrating an outline of a cutting-out process of step S2. FIG. 5 schematically shows how a plate-like blank-material piece 2 is cut out from the raw-material piece 1 through cutting or the like. In the cutting-out process, the blank-material piece 2 is cut out in such a manner that the blank-material piece 2 includes a portion where the bending force is applied. More specifically, cutting-out process is performed in such a manner that the blank-material piece 2 has a curved surface with a curvature substantially larger than the curvature of the grain G of the raw-material piece 1, and that the surface extends in a plate-like shape intersecting with plural grains of the raw-material piece 1. In this sense, an arc shape (indicated by hatching) shown in a side surface of the raw-material piece 1 in FIG. 5 corresponds to a section along line D-D of the blank-material piece 2 shown to the right below the arc shape. The volume of the blank-material piece 2 cut out in step S2 includes a volume to be lost in the compression process of step S4 described later. Here, "plate-like" means a three-dimensional shape having a curved surface in general, such as a bowl-like, shell-like, box-like, and boat-like shape, and the shape shown in FIG. 5 is merely an example. In the cutting-out process, a flat board-like blank-material piece may be cut out from the raw-material piece 1.

Subsequently, the blank-material piece 2 is left for a predetermined time period in a water vapor atmosphere of a temperature and a pressure higher than those of the atmospheric air. Thus, the blank-material piece 2 absorbs moisture excessively and is softened sufficiently (step S3). Here, "a temperature and a pressure higher than those of the atmospheric air" refers to a temperature of approximately 100 to 230° C., preferably 180 to 230° C., and more preferably 180 to 200° C., and a pressure of approximately 0.1 to 3.0 MPa (megapascal), preferably 0.45 to 2.5 MPa, and more preferably 1.0 to 1.6 MPa. Instead of leaving the blank-material piece 2 in the water vapor atmosphere mentioned above for softening in step S3, one can soften the blank-material piece 2 by heating with high-frequency electromagnetic waves such as microwaves.

Figure 6:
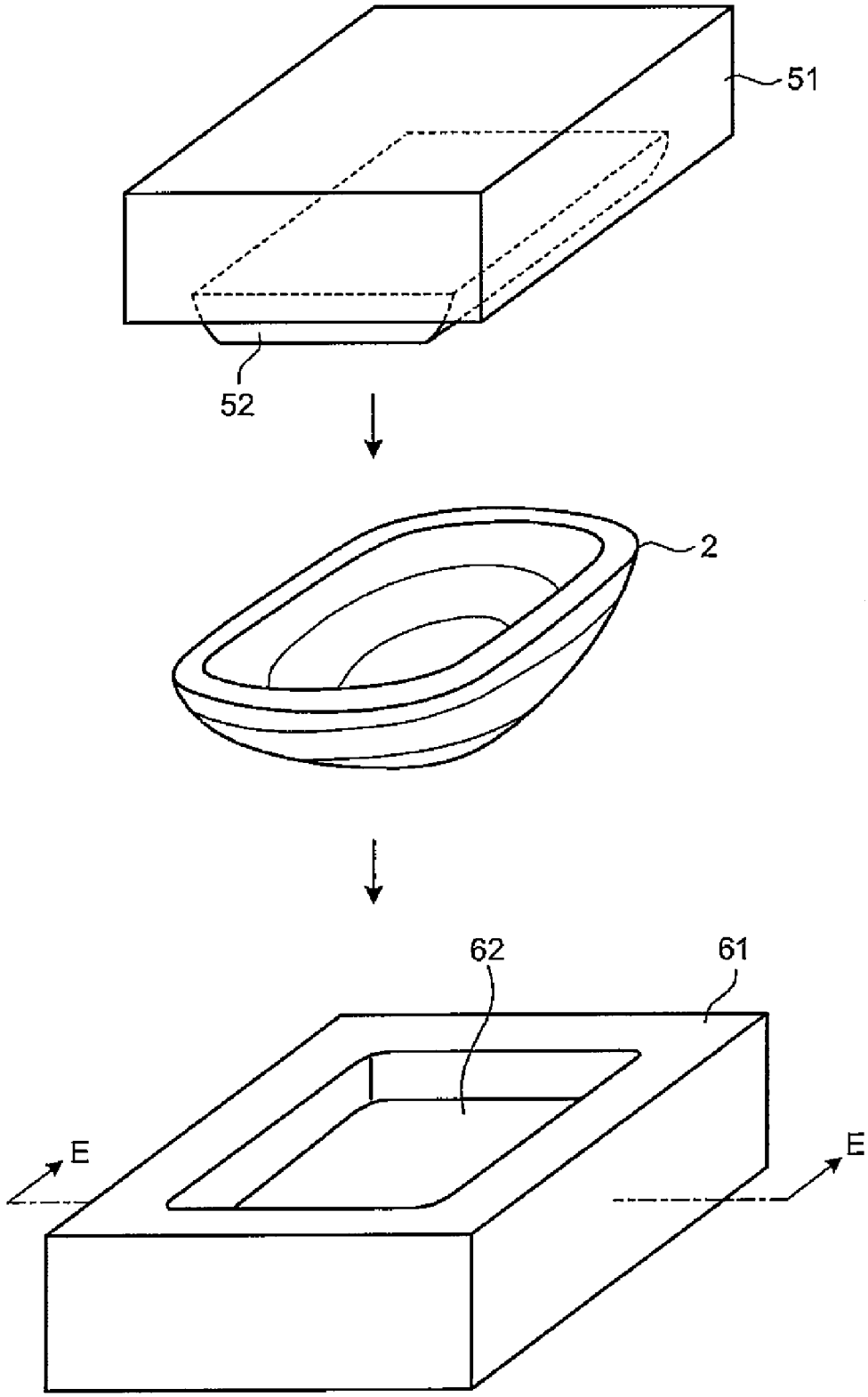
FIG. 6 is a schematic view illustrating an outline of a compression process of the method of processing a wooden piece according to the first embodiment of the present invention.
Figure 7:
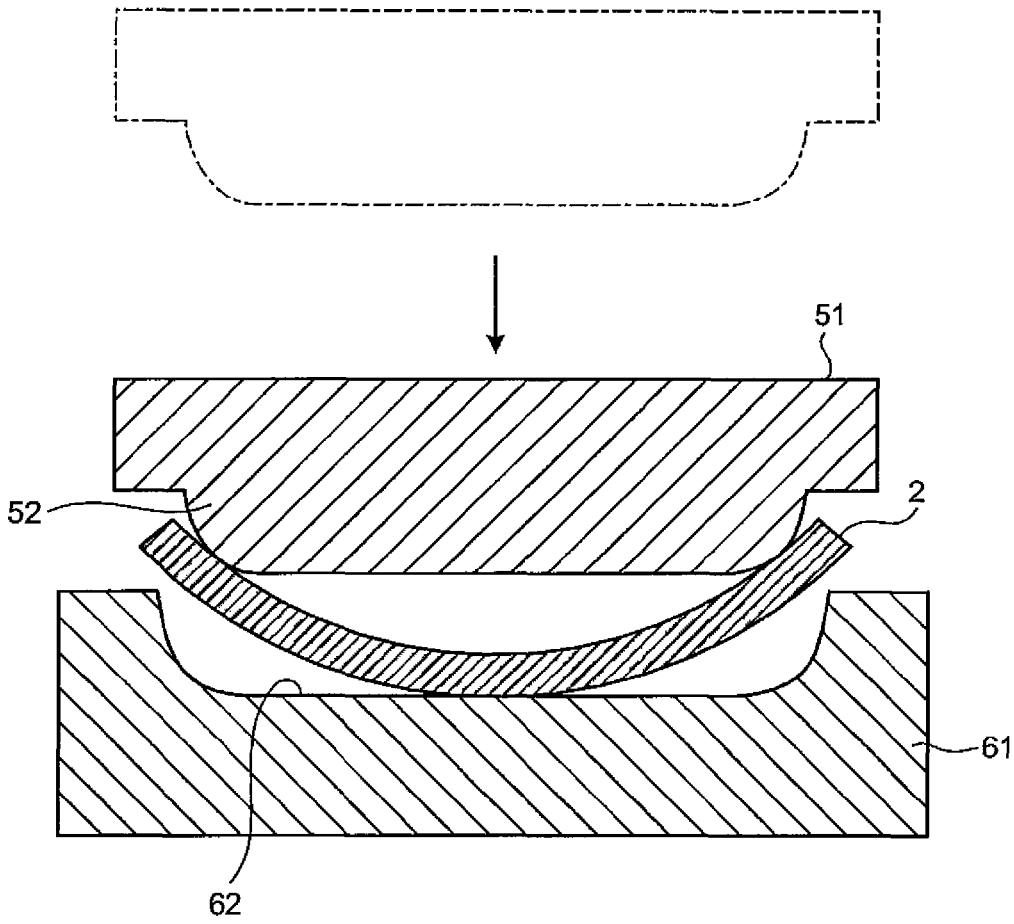
FIG. 7 is a schematic view of a wooden piece starting to be compressed in the compression process.

Thereafter, the blank-material piece 2 which is softened sufficiently in step S3 is compressed (step S4). FIG. 6 shows an outline of a compression process, and shows the blank-material piece 2 upside down from a direction shown in FIG. 5. FIG. 7 shows a state where a metal mold 51 touches the blank-material piece 2 and compressive force of metal molds 51 and 61 starts working on the blank-material piece 2. FIG. 7 is a vertical sectional view corresponding to a section along line E-E of the blank-material piece 2 and the metal molds 51 and 61 shown in FIG. 6. In these drawings, the metal mold 51 which applies compressive force to the blank-material piece 2 from above is a core metal mold including a protruding portion 52 which can be brought into contact with a curved surface (inner side surface) corresponding to a depressed portion of the blank-material piece 2. On the other hand, the metal mold 61 which applies compressive force to the blank-material piece 2 from below in FIGS. 6 and 7 is a cavity metal mold including a depressed portion 62 which can be brought into contact with a curved surface (outer side surface) corresponding to a protruding portion of the blank-material piece 2.

In step S4, at least one of the metal molds 51 and 61 is moved toward another of the metal molds 51 and 61 in the same water vapor atmosphere as that employed in the softening process, so that the blank-material piece 2 is sandwiched and receives compressive force, whereby the shape of the blank-material piece 2 is formed in a predetermined three-dimensional shape. In the first embodiment, a case where the metal mold 51 descends toward the metal mold 61 is described.

Figure 8:
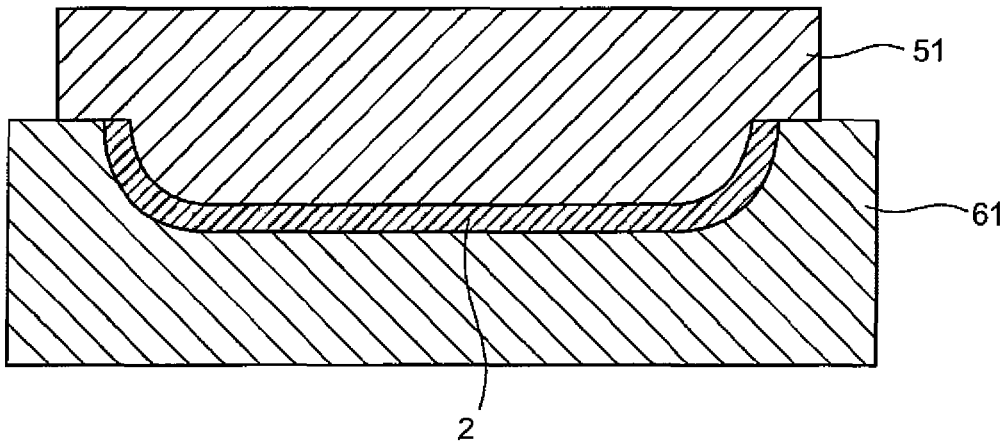
FIG. 8 is a schematic view of a wooden piece whose deformation has been nearly finished in the compression process.

When the metal mold 51 descends from the state shown in FIG. 7, the blank-material piece 2 receives the compressive force from the metal molds 51 and 61, and gradually deforms. As a result, an upper surface of the blank-material piece 2 is brought into close contact with a surface of the protruding portion 52 of the metal mold 51, while a lower surface of the blank-material piece 2 is brought into close contact with a surface of the depressed portion 62 of the metal mold 61. FIG. 8 shows the blank-material piece 2 in a close-contact state with the metal molds 51 and 61 where the deformation of the blank-material piece 2 in the compression process is nearly finished. As shown in FIG. 8, the blank-material piece 2 deforms into a three-dimensional shape corresponding to a gap between the metal molds 51 and 61.

Thickness of the blank-material piece 2 after compression is preferably approximately 30% to 50% of the thickness of the blank-material piece 2 before the compression. In other words, compression rate of the blank-material piece 2 (rate $\Delta R/R$ of a decreased amount of thickness $\Delta R$ of the wooden piece after the compression to thickness R of the wooden piece before the compression) is preferably approximately 0.50 to 0.70.

When at least one of the metal molds 51 and 61 is moved toward another of the metal molds 51 and 61 in step S4, compressive force applied to the blank-material piece 2 may be adjusted through the use of an appropriate driving unit which electrically moves at least one of the metal mold 51 and the metal mold 61. Alternatively, the metal molds 51 and 61 may be connected via a screw, and the metal mold 51 is moved toward the metal mold 61 in a vertical direction through manual or automatic fastening of the screw.

After the compressive force is applied to the blank-material piece 2 for a predetermined time period (one to a few tens minutes, or more preferably approximately five to ten minutes) in step S4, the water vapor atmosphere is removed and the blank-material piece 2 is dried (step S5). Thereafter, the metal molds 51 and 61 are separated from each other. As a result, the shape of the blank-material piece 2 is fixed. The blank-material piece 2 whose shape is fixed through step S5 is referred to as "wooden piece 3" hereinbelow.

Figure 9:
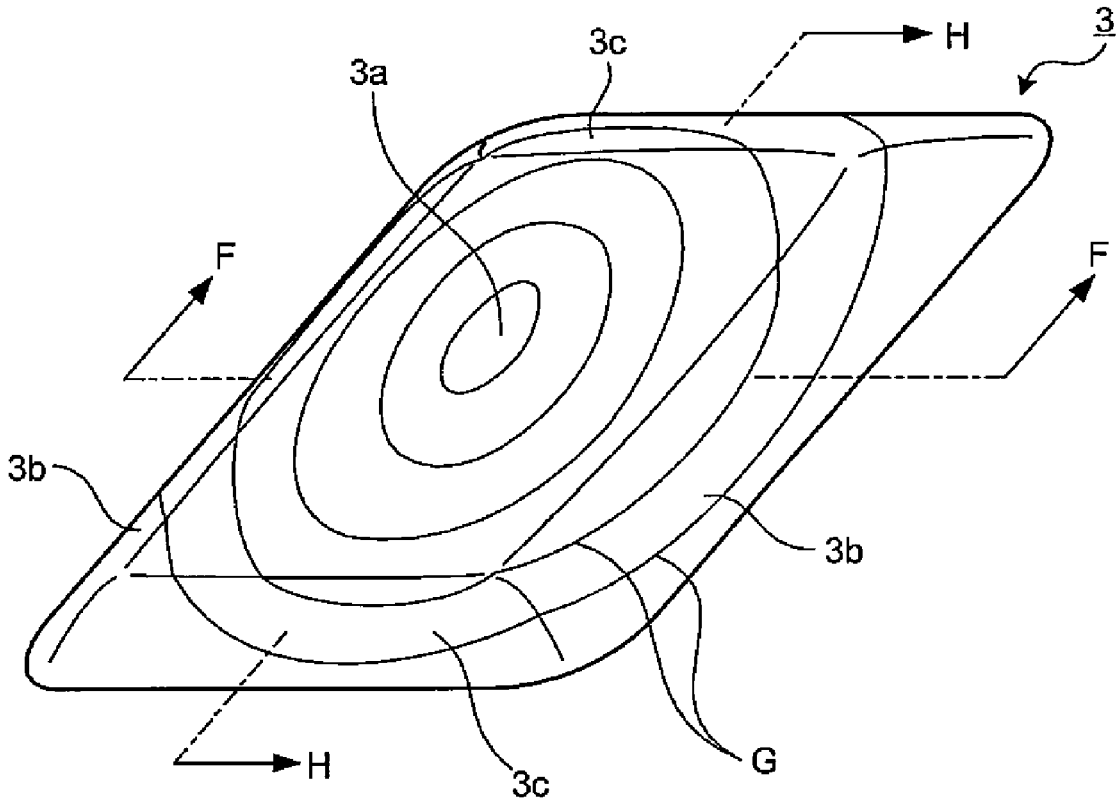
FIG. 9 is a perspective view of a configuration of a wooden piece after shape-forming through compression.
Figure 10:
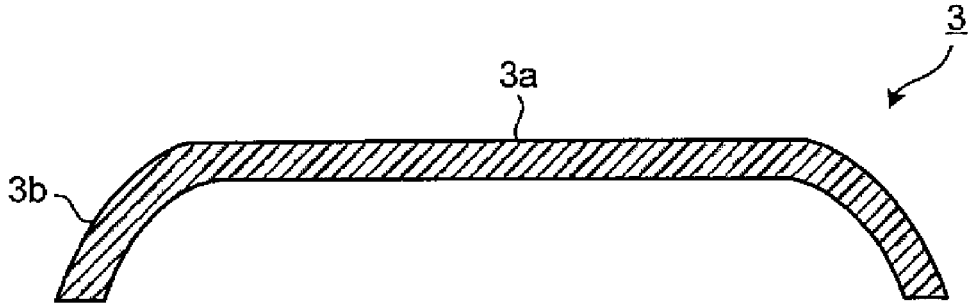
FIG. 10 is a sectional view along line F-F of FIG. 9.

FIG. 9 is a perspective view of a configuration of the wooden piece 3. FIG. 10 is a sectional view along line F-F of FIG. 9. The wooden piece 3 shown in FIGS. 9 and 10 includes a flat board-like main plate portion 3*a* having a substantially rectangular surface, two side plate portions 3*b* extending respectively from longitudinal sides of the surface of the main plate portion 3*a* substantially parallel to the longitudinal direction of the surface of the main plate portion 3*a* and curving upward from the main plate portion 3*a*, and two side plate portions 3*c* extending respectively from two short sides of the surface of the main plate portion 3*a* substantially parallel to a short-side direction of the surface of the main plate portion 3*a* and curving upward from the main plate portion 3*a*. An edge surface of the side plate portion 3*b* leads to an edge surface of the side plate portion 3*c* so that the edge surfaces of the side plate portions 3*b* and 3*c* together form a closed circular shape. Further, the thickness of the wooden piece 3 is substantially uniform. A section along line H-H of FIG. 9 is similar to FIG. 10 (which is a section along line F-F of FIG. 9) except the dimension and slight difference in shape.

Figure 11:
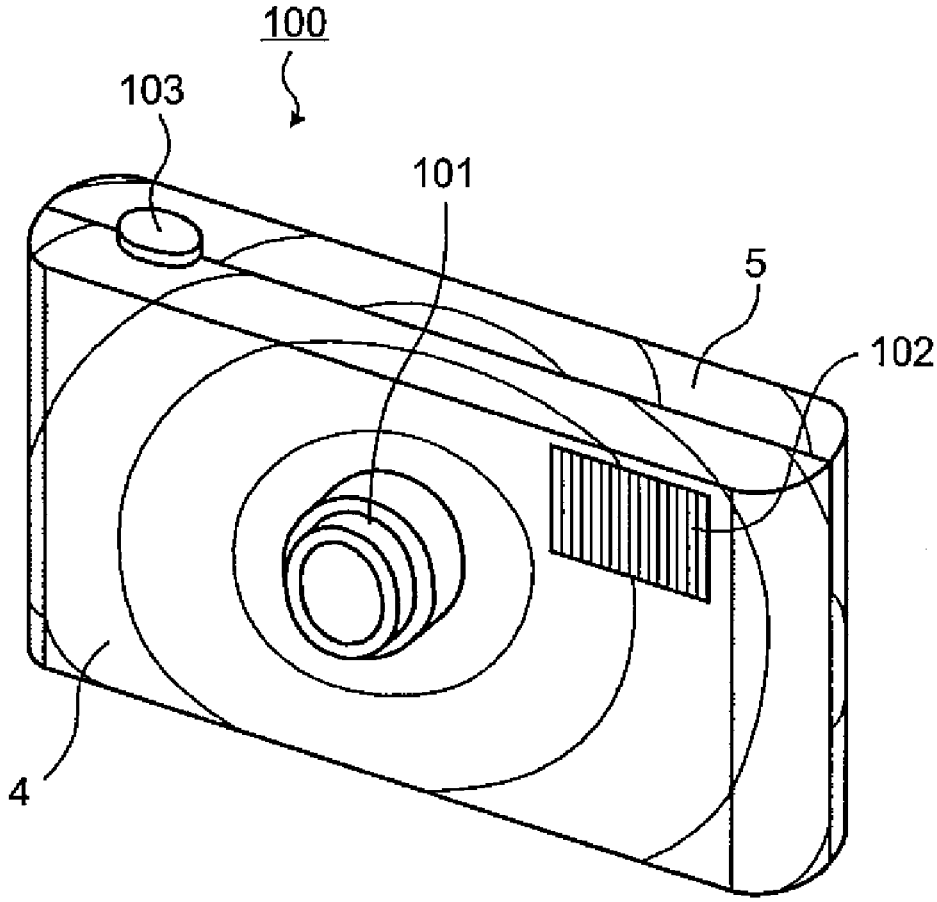
FIG. 11 is a perspective view of an external configuration of a digital camera which is an example of an application of a wooden piece whose shape is formed through the method of processing a wooden piece according to the first embodiment of the present invention.

In subsequent step S6, the wooden piece 3 is shaped through processing such as cutting and drilling (step S6). FIG. 11 is a perspective view of an external configuration of a digital camera which is an example of an application of the wooden piece 3 shaped through step S6. A digital camera 100 shown in FIG. 11 is covered with cover members 4 and 5 which are formed from the wooden pieces 3 and in which appropriate openings and cut-outs are formed in the shaping process of step S6. The digital camera 100 includes an imaging unit 101 including an imaging lens, a flash 102, and a shutter button 103. Inside the digital camera 100, various electronic components and optical components that realize functions of the digital camera 100 are housed, such as a control circuit controlling driving of processes such as an imaging process, a solid-state imaging sensor such as a charge-coupled device (CCD) and a complementary metal-oxide semiconductor (CMOS), a microphone and a speaker for audio input and output, and a driving circuit that drives each functional unit under the control of the control circuit (not shown).

Other than the digital camera 100, a jacket member obtained through the shaping of the wooden piece 3 can be applied to various electronic devices such as portable telephones, portable communication terminals such as personal handyphone systems (PHS) and personal digital assistants (PDA), portable audio devices, IC recorders, portable televisions, portable radios, remote controls for various electronic appliances, and digital videos. When the jacket member is applied to these small portable electronic devices, appropriate thickness is approximately 1.6 to 2.0 mm.

The first embodiment of the present invention as described above provides a method of processing a wooden piece, and the method includes a bending process for bending a raw-material piece which is a wooden piece to be processed and placed in a humid condition of high temperature, a cutting-out process for cutting out a blank-material piece from the raw-material piece bent in the bending process so that the blank-material piece includes at least a part of a bent portion, and a compression process for applying a compressive force in a water vapor atmosphere of a temperature and a pressure higher than those of the atmospheric air to the blank-material piece cut out in the cutting-out process, thereby realizing a wide variety of grain patterns and easy shape-forming of the wooden piece.

Compared with a conventional technique according to which the blank-material piece is cut out from an unbent raw-material piece, the first embodiment, according to which the blank-material piece is cut out from a preliminarily-bent raw-material piece, can obtain the same grain pattern without cutting out a blank-material piece in a disorderly form as in the conventional technique. Therefore, an amount of deformation of the blank-material piece in the compression process can be minimized. As a result, generation of cracks and the like during the compression can be more securely prevented, whereby a production yield can be improved.

Figure 12:
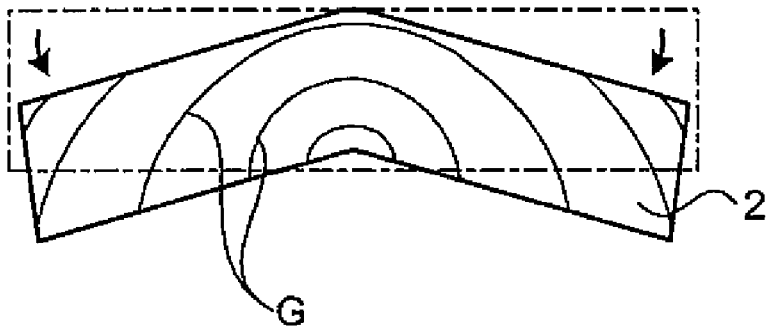
FIG. 12 is a schematic view illustrating an outline of the bending process of the method of processing a wooden piece according to the first embodiment of the present invention (second example)

The bending process of the method of processing a wooden piece according to the first embodiment is not limited to the one described above. FIG. 12 shows another example of the bending process (second example). In FIG. 12, two edge portions in the short-side direction of the raw-material piece 1 are folded toward the center of the short-side direction. FIG. 12 schematically shows an outline of the bending process as seen from a direction of an arrow B of FIG. 2.

Figure 13:
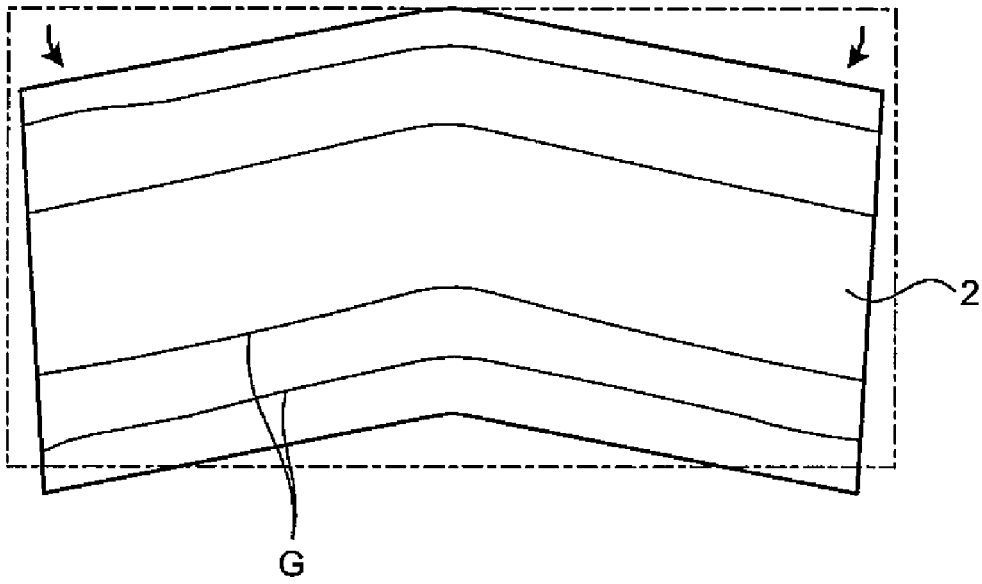
FIG. 13 is a schematic view illustrating an outline of the bending process of the method of processing a wooden piece according to the first embodiment of the present invention (third example)

Further, FIG. 13 shows still another example of the bending process (third example). In FIG. 13, two edge portions in the longitudinal direction of the raw-material piece 1 are folded toward the center of the longitudinal direction. FIG. 13 schematically shows an outline of the bending process as seen from a direction of an arrow C of FIG. 2.

Thus, the raw-material piece 1 can be bent in various directions. Density of grains can be adjusted and the grain pattern can be distorted according to the manner of bending. Therefore, the method of processing a wooden piece according to the first embodiment can produce a compressed wood product having a unique grain pattern which cannot be obtained through the conventional techniques. The wooden piece may be bent in a vertically reverse direction of the direction shown in FIGS. 4, 12, and 13. Further, plural bending processes as described may be combined.

In the first embodiment, it is possible to bend a raw-material piece in a state of a log before planing instead of bending a flat board-like raw-material piece.

Further, in the first embodiment, the wooden piece after the compression may have a flat board-like shape.

Second Embodiment

A method of processing a wooden piece according to a second embodiment of the present invention is characterized in that plural logs which are raw-material pieces are stacked in a radial direction and bent together.

Figure 14:
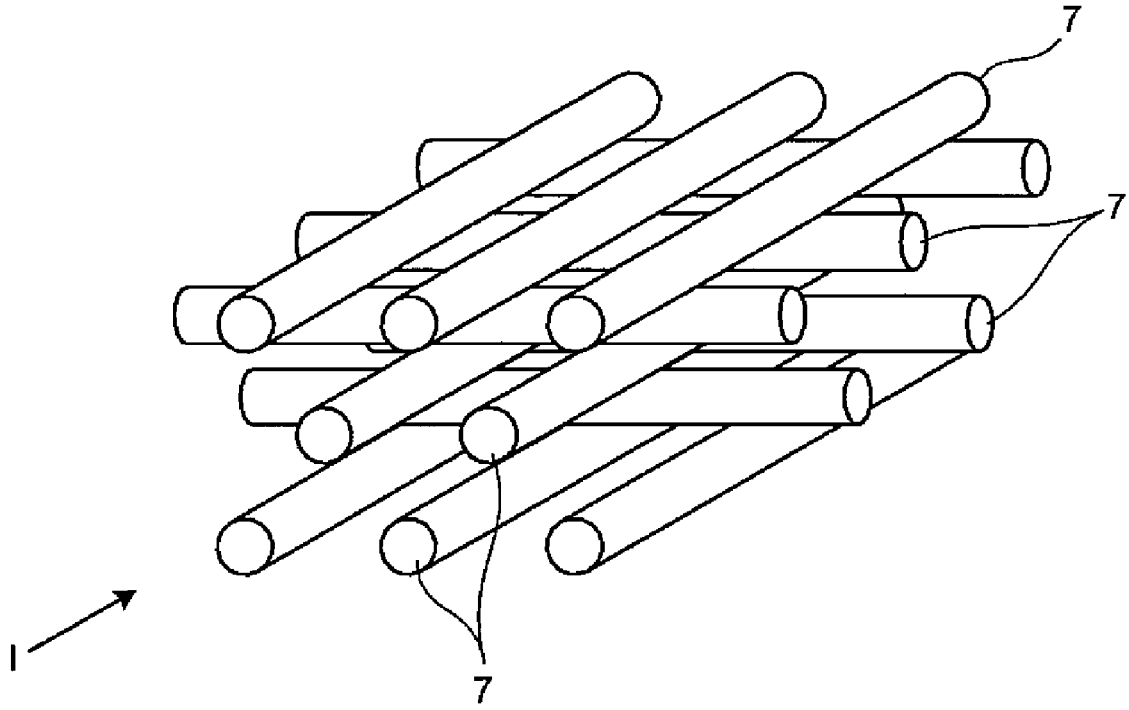
FIG. 14 is a schematic view showing how raw-material pieces (logs) are combined in a bending process of raw-material pieces in a method of processing a wooden piece according to a second embodiment of the present invention.
Figure 15:
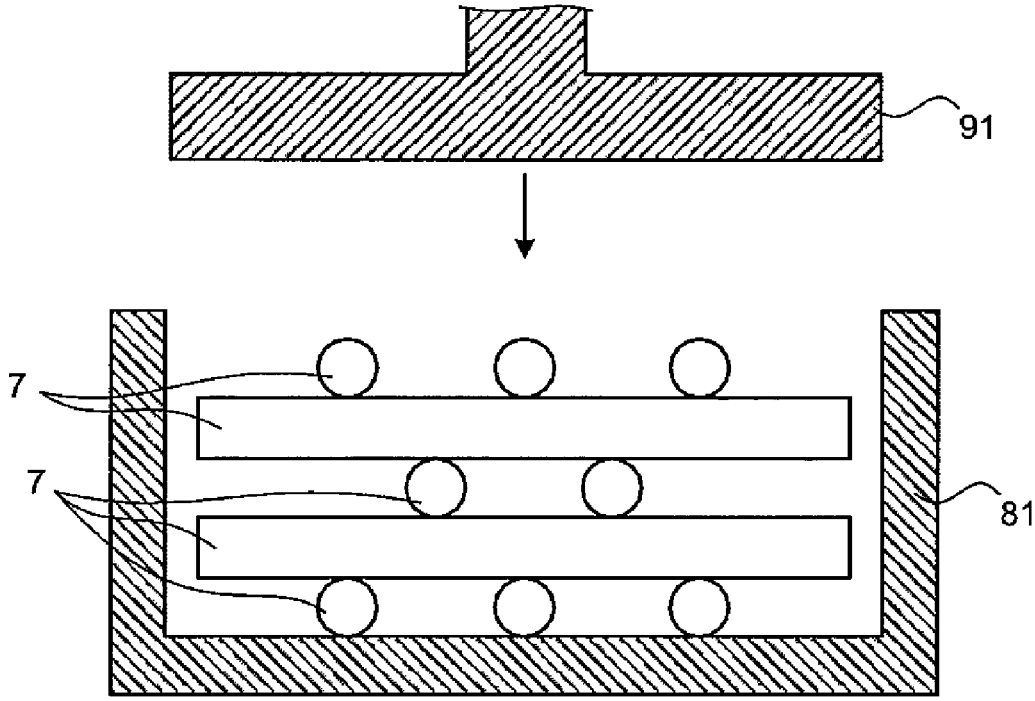
FIG. 15 is a schematic view illustrating an outline of the bending process (before the logs are bent) of the method of processing a wooden piece according to the second embodiment of the present invention.
Figure 16:
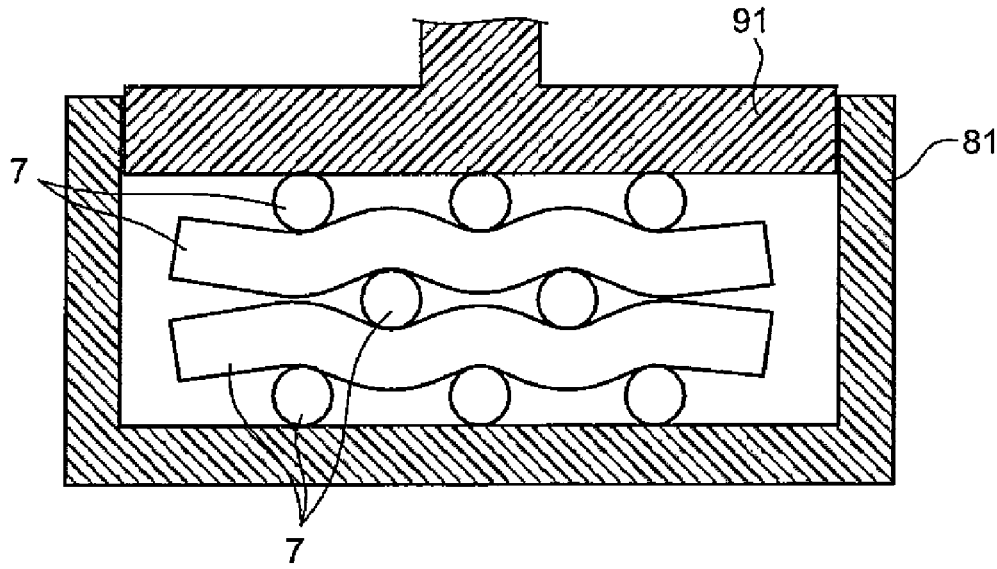
FIG. 16 is a schematic view illustrating an outline of the bending process (after the logs are bent) of the method of processing a wooden piece according to the second embodiment of the present invention.

FIGS. 14 to 16 are schematic diagrams for explaining a bending process of the method of processing a wooden piece according to the second embodiment. In the bending process of the second embodiment, plural logs 7 are arranged next to one another across the longitudinal direction and form one layer, and plural layers of logs are stacked one on another so that the longitudinal direction of logs 7 of one layer intersects with the longitudinal direction of logs 7 of an adjacent layer, and logs 7 of one layer are aligned with logs 7 of an adjacent layer in a radial direction as shown in FIG. 14. In the example shown in FIG. 14, the longitudinal direction of the logs of one layer is perpendicular to the longitudinal direction of the logs of another layer adjacent in a direction of stacking (vertical direction of FIG. 14). Further, the logs 7 in one layer are arranged in such a manner that they are not directly below or above the logs 7 arranged in the same longitudinal direction in a closest layer. When plural logs 7 are arranged in this manner, each log 7 can be easily bent with little compression of the log 7.

FIG. 15 is a schematic view illustrating an outline of the bending process of the plural logs 7 stacked as described above. FIG. 15 is a partial sectional view of a state before the plural logs 7 are bent. Plural logs 7 are placed inside a predetermined storage chamber 81 and kept in the humid condition of high temperature same as the condition in the first embodiment. A section of the logs 7 shown in FIG. 15 corresponds to a view from a direction of an arrow I of FIG. 14. While the logs are kept in the state shown in FIG. 15, a pressing member 91 having a surface area larger than an area encircled by an outer contour of each layer of plural logs 7 is lowered gradually from above the logs 7. The pressing member 91 is driven vertically upward and downward by an appropriate driving unit.

FIG. 16 is a partial sectional view of the plural logs after the pressing member 91 descends and the plural logs 7 are bent. Plural logs 7 receiving a force from the pressing member 91 are gradually bent and deform so as to have a substantially wave-like shape along the longitudinal direction. Desirably, the force applied to the logs 7 by the pressing member 91 is of such a level that the diameter of the log 7 does not change significantly through the bending process. Though not shown, the logs 7 of a middle layer in FIG. 14 have a substantially wave-like form in the longitudinal direction after the bending similarly to the logs 7 in adjacent layers below and above (see FIG. 16).

In the state as shown in FIG. 16, the logs 7 arranged in the uppermost and the lowermost layers scarcely undergo significant deformation through the bending. However, these logs 7 can be bent slightly in the horizontal direction in FIG. 16. To make the degree of bending of the logs 7 arranged in the uppermost and the lowermost layers equal to the degree of bending of the logs 7 arranged in intermediate layers, gaps for accommodating the bent logs 7 may be secured between the uppermost layer and the pressing member 91 and between the lowermost layer and the bottom surface of the storage chamber 81 prior to the bending process.

Figure 17:
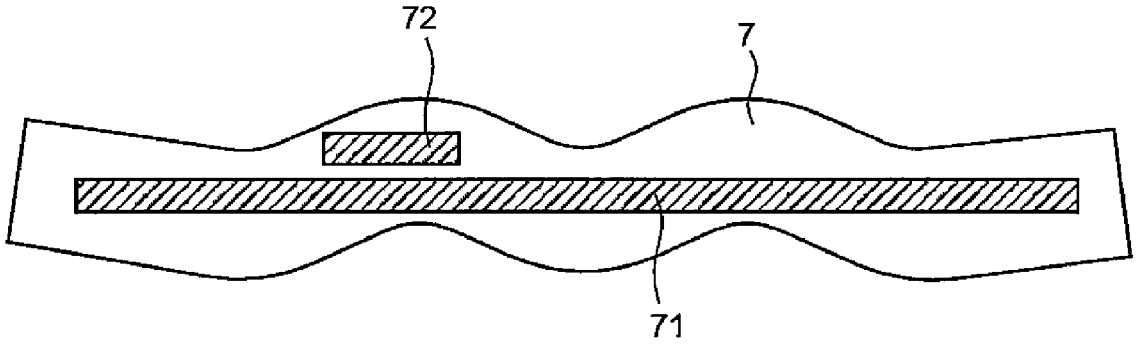
FIG. 17 is a schematic view illustrating an outline of a cutting-out process of the method of processing a wooden piece according to the second embodiment of the present invention.

FIG. 17 is a schematic view illustrating an outline of a cutting-out process of the method of processing a wooden piece according to the second embodiment. In the cutting-out process, the log 7 bent as described above is sliced so that a substantially central portion, through which a central axis in the longitudinal direction of the log 7 passes, is cut out. From the cut-out piece, i.e., a flat plate 71, a blank-material piece is cut out. Alternatively, the bent log 7 may be sliced so that a portion closer to a radially peripheral portion is cut out as a flat plate 72. The blank-material piece may be cut out from the flat plate 72. Depending on the shape of the blank-material piece, the blank-material piece can be cut out from any portion other than those mentioned above. The bent log 7 may be sliced so that the cut-out blank-material piece has a three-dimensional shape having a curved surface.

Each of the softening process, compression process, drying process, and shaping process applied to the blank-material piece cut out in the cutting-out process as described above is the same as those of the method of processing a wooden piece according to the first embodiment described above.

The second embodiment of the present invention as described above can provide a method of processing a wooden piece including a bending process for bending a raw-material piece which is a wooden piece to be processed and placed in the humid condition of high temperature, a cutting-out process for cutting out a blank-material piece from the raw-material piece bent in the bending process so that the blank-material piece includes at least a part of a bent portion of the raw-material piece, and a compression process for applying a compressive force in a water vapor atmosphere of a temperature and a pressure higher than those of the atmospheric air to the blank-material piece cut out in the cutting-out process, thereby realizing a wide variety of grain patterns and easy shape-forming of the wooden piece.

Further, since the plural logs are bent together in the second embodiment, a time required for the bending process can be shortened.

Further, in the second embodiment, the logs 7 of one layer are not necessarily perpendicularly arranged relative to the logs 7 in an adjacent layer stacked right above or right below, and the logs 7 may simply intersect with the logs 7 of the adjacent layer. Still alternatively, the longitudinal directions of the logs 7 in the same layer are not necessarily parallel with each other. When the logs 7 are stacked irregularly and bent, a wider variety of grain patterns can be realized.

In the above, the exemplary embodiments of the present invention are described. The present invention, however, is not limited to two embodiments described above. For example, the raw-material piece employed in the present invention may not be a flat-grain piece, and can be a straight-grain piece, a piece having an intermediate grain pattern between the flat-grain and straight-grain, or an end-grain piece. Further, the blank-material piece cut out from the raw-material piece can be a piece other than the flat-grain piece. As can be understood, in the present invention, a manner of cutting out a wooden piece to be processed from the raw-material piece can be determined depending on various factors, such as a purpose of use of a compressed wood product obtained as a result of processing of the wooden piece, a required strength of the compressed wood product, and a grain pattern desirable in the compressed wood product.

Further, the compressed wood product obtained through the processes of the method of processing a wooden piece according to the present invention can be used for other purpose than as a jacket member of an electronic device as mentioned above. For example, the compressed wood product processed through the method of processing a wooden piece according to the present invention can be used as a table ware and as casings of various types. Still alternatively, the compressed wood product can be used as a building material.

As can be seen from the foregoing, the present invention can include various embodiments not specifically described above. Various modifications of design and the like can be made without departing from the technical concepts as identified in the appended claims.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of processing a wooden piece into a predetermined shape by compressing the wooden piece, comprising:

placing a wooden raw-material piece in a humid condition at high temperature;

then bending the raw-material piece;

cutting out a blank-material piece from the raw-material piece bent in the bending so that the blank-material piece includes at least a part of a bent portion of the raw-material piece; and compressing the blank-material piece cut out in the cutting out in a water vapor atmosphere of a temperature and a pressure higher than those of an atmospheric air.

2. The method according to claim 1, wherein the raw-material piece is a flat board, and the bending includes bending the raw-material piece along one of surfaces of the raw material piece.

3. The method according to claim 1, wherein the raw-material piece is a log, and the bending includes collectively bending plural raw-material pieces arranged and stacked in a radial direction so that longitudinal directions of the raw-material pieces intersect with each other.

4. The method according to claim 1, wherein the compressing includes applying a compressive force to the blank-material piece by sandwiching the blank-material piece between plural metal molds.

5. The method according to claim 1, wherein the compressing includes forming the blank-material piece into a three-dimensional shape including a curved surface.

6. The method according to claim 1, wherein the cutting includes cutting out blank-material piece so that at least one surface of the blank-material piece intersects with plural grains in a bent portion of the raw-material piece.

* * * * *